United States Patent [19]

Tsai

[11] 4,355,521

[45] Oct. 26, 1982

[54] REFRIGERATOR-OVEN COMPLEX

[76] Inventor: Yun-Ting Tsai, 7, Chung Cheng Rd., Sec. 1, Yangmingshan, Taipei, Taiwan, 113

[21] Appl. No.: 188,928

[22] Filed: Sep. 19, 1980

[51] Int. Cl.[3] ..... F25B 41/00; F25B 29/00

[52] U.S. Cl. ..... 62/196 B; 62/238.6; 165/30; 165/63

[58] Field of Search ..... 62/238.6, 196 B; 165/30, 63, 29; 237/2 B

[56] References Cited

U.S. PATENT DOCUMENTS

| | | | |
|---|---|---|---|
| 1,235,056 | 7/1917 | Renner | 165/63 |
| 2,597,745 | 5/1952 | Morrison | 62/238.6 X |
| 3,926,008 | 12/1975 | Webber | 62/238.6 X |
| 4,240,266 | 12/1980 | Scrine et al. | 62/196 B |

*Primary Examiner*—William E. Wayner

*Attorney, Agent, or Firm*—Robert E. Burns; Emmanuel J. Lobato; Bruce L. Adams

[57] ABSTRACT

The present invention provides for a refrigerator-oven complex based on the principle of the operative circuitry of the conventional refrigerator or freezer, specifically it means the additional incorporation of an empty box with temperature conservancy equipments at a suitable quarter of the conventional refrigerator or freezer, the said additional empty box will be referred to as the oven hereafter, the high temperature evaporation tube as the exhaust of the compressor of the refrigerator or the freezer is extended into the oven, the calorific power is diffused in the oven by means of several curved tubeworks and various ways of heat-diffusion so as to afford heating for objects such as foods or temperature conservation for them. Or else the calorific power may be drawn to the chambers where hot air is required by fans so as to permit adjustment of the room (chamber) temperature, the evaporation tubes that have been treated for heat-diffusion are fed into the tubeworks of the refrigerant-cooler, thence recycled back to the compressor with the commonly known technique, the invention so claimed is characteristic in best exploitation of the calorific power that has been so far left over as remanets roving in the atmosphere so as to reduce waste of thermal energy without affecting the normal running operation of the refrigeration, nor will it incur increase in electric power consumptions.

10 Claims, 7 Drawing Figures

REFRIGERATOR-OVEN COMPLEX

BRIEF SUMMARY OF THE INVENTION

Generally speaking, two physical principles are adopted in the practice of lowering temperature within a refrigerator by reason of drawing away the thermal units from within: one is that the ambient pressure is associated with the evaporation procedure of the liquid, take for example, under 1 standard atmospheric condition water will become steam at 100° C., however under 0.1 atmospheric pressure it would become steam, by retrospective reasoning from the steam table, at 50° C. If the pressure is enhanced to 1 atmospheric pressure, the steam will become a liquid. The other is that any liquid will absorb heat while transforming to the gas, and release like quantity of heat as the gas is reduced to the liquid form. Gases such as ammonium or hydrogen that have a lower boiling point or liquefied gases may attain their boiling point at a comparatively lower temperature under normal pressure conditions, such liquids may evaporate at low temperatures and absorb the heat in the surroundings, if high pressure is imposed on the evaporated steams, then the steams will get cooled down and become liquid under room temperature due to enhancement in boiling point, and release the temperature at the same time. Should this liquid be dilated to normal pressure, then a new cycle will start all over again. The present invention can fully utilize the calorific power on the point of being consumed, to intercept and conserve it to convert into the function of temperature conservation for desired objects, in the meanwhile the refrigeration efficiency is achieved for the refrigerant-cooler.

From the above mentioned principles it is learned the chief objective for maintaining a high pressure for the refrigerant is to push for the convenient liquefaction for the steam (gas), so it will only be necessary to keep a certain pressure within the tubeworks to achieve in the liquefaction effect, in the meanwhile let the same pressure be maintained for all spaces disregarding their sizes, the means of treatment is very easy, all that has to be done is to enhance the pressure inside the tubes. What is noteworthy is that the space additionally required for the cooling tube (heat-diffusing tube) under room temperature for the present invention is not so spacious, that would not affect the refrigeration efficiency, but that the heat-absorption action taking place in the oven by the objects stored in it will still accelerate the cooling function of the steam in the evaporator, so the meritorious point is that one action will be favorably recompensated by the other action.

BRIEF DESCRIPTION OF THE SEVERAL VIEWS OF THE DRAWINGS

Shown in FIG. 1 is a three dimensional ideological graph of the refrigerator-oven complex, namely, the present invention, in execution, as viewed in part from the backside, shown in the upper part is the oven with provision of horizontally aligned radiating pipe, in the lower part is the refrigerator.

Shown in FIG. 2 is a partial three dimensional ideological graph of the refrigerator-oven complex, namely, the present invention, as viewed from another angle, in execution, shown on the right side is the oven, wherein the lower part houses the vertically aligned radiating pipe, whereas the vertical radiating pipe is housed on the upper side, shown in the leftside is the refrigerator.

Figure 3:
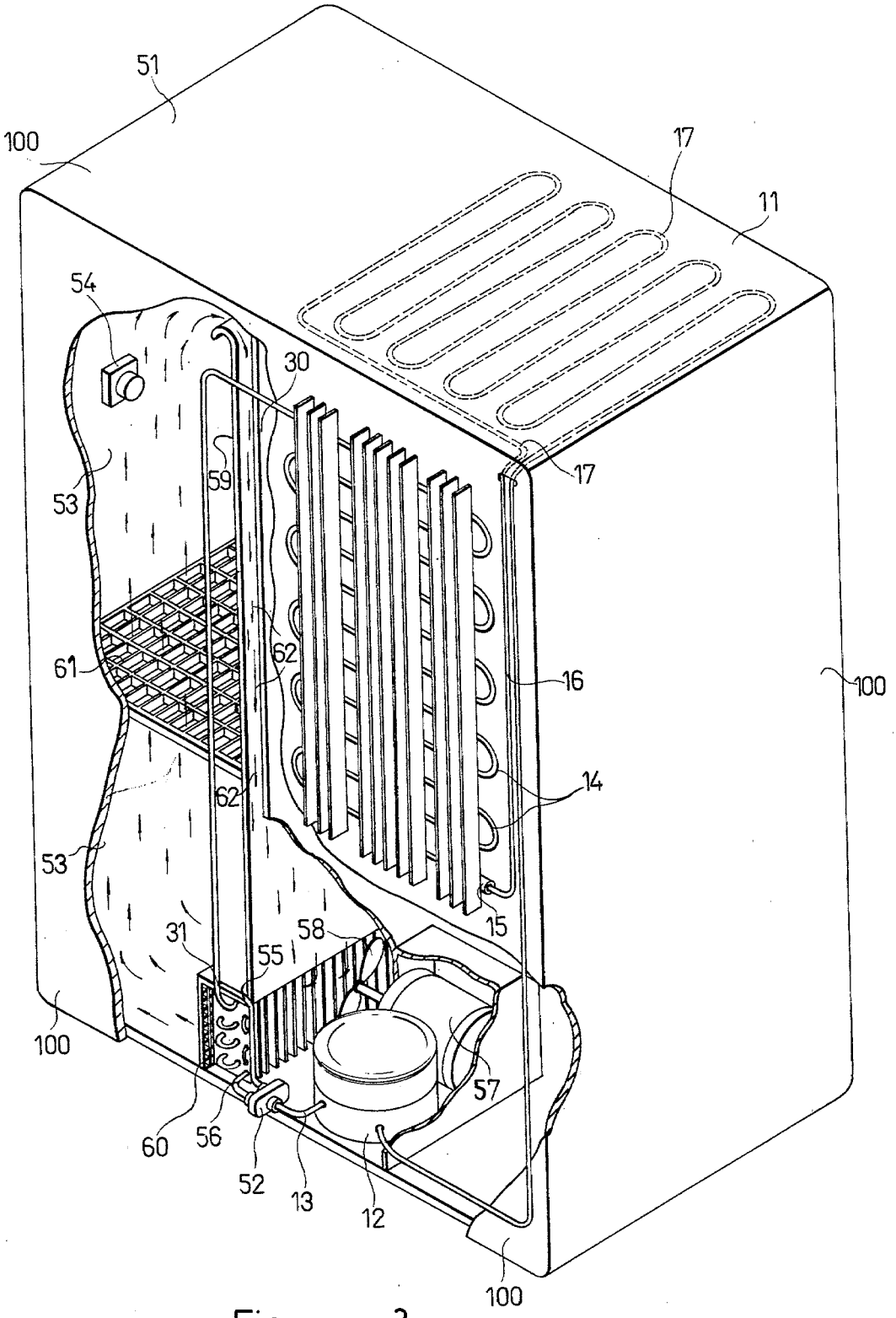

Shown in FIG. 3 is still another three dimensional ideological graph of the refrigerator-oven complex, namely, the present invention, in execution, as viewed from yet another angle, what is shown on the leftside is the oven, the calorific power as contained in the fin-type radiator (heat-diffuser) coming from the fan in the oven is cycling about in the oven, on the rightside is the refrigerator.

Figure 4B:
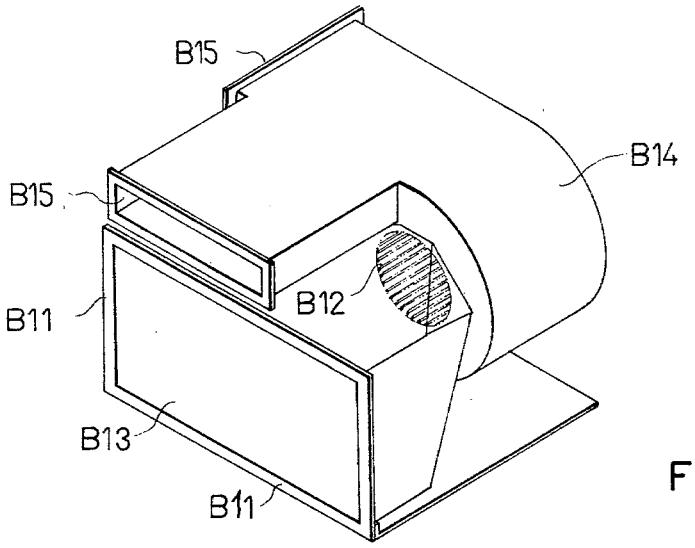
Figure 4A:
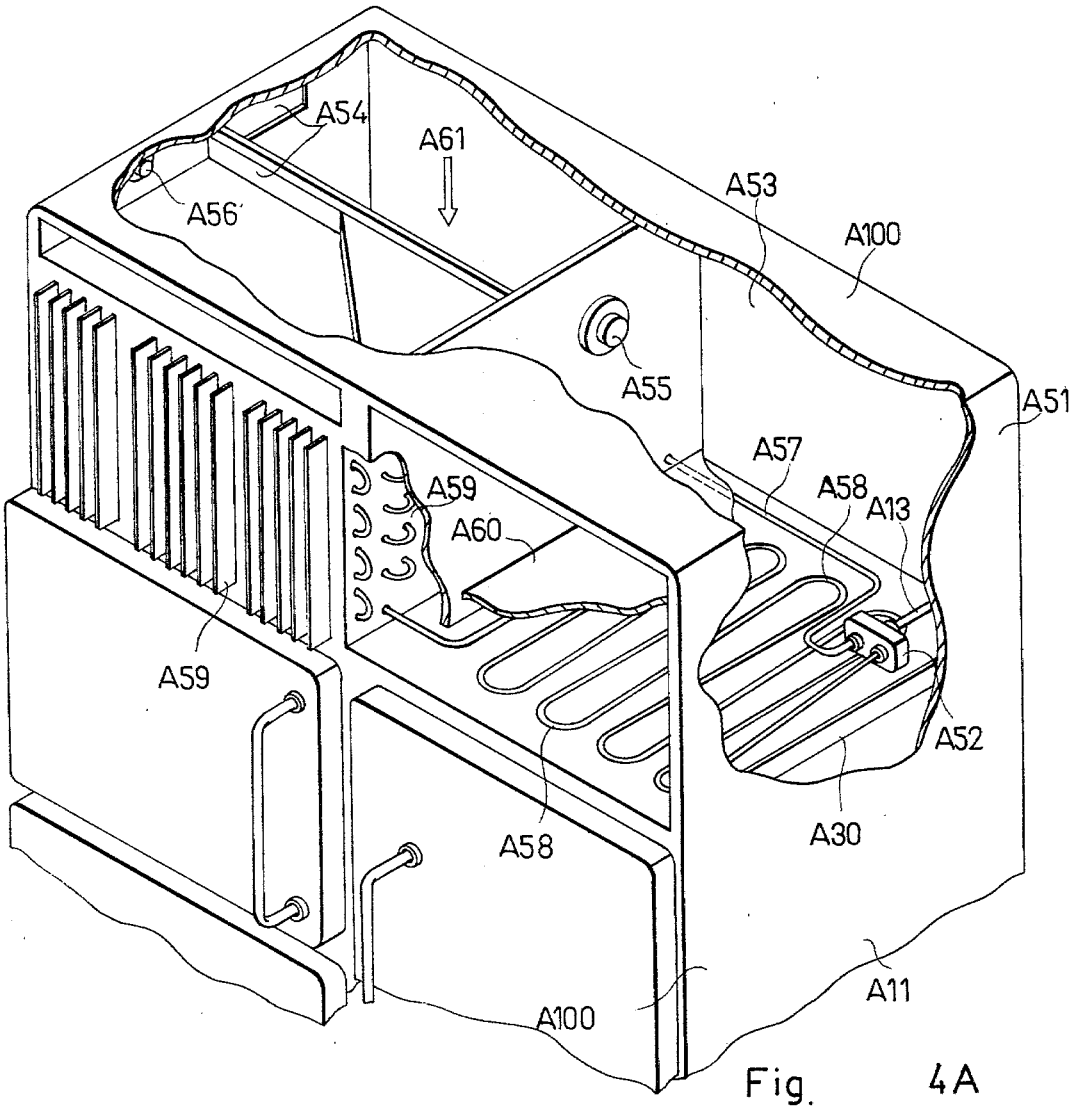

Shown in FIG. 4A is yet another three dimensional ideological graph of the refrigerator-oven, namely, the present invention, in execution, as viewed from the facade, in partial illustration, that part as shown on the upper right portion is the oven, the interior of the oven houses the horizontally aligned radiator. Shown on the upper leftside is the fin-type radiator, the calorific power as contained therein is drawn into the room requiring heating by the air extraction unit that is illustrated in FIG. 4B. The lower part is the freezing cabin of the large-size refrigeration system.

Shown in FIG. 4B is the air extraction unit as installed in the compound represented by FIG. 4A, its function is to extract the calorific power as contained in the fin-type radiator for feeding as inputs into the room where heating (hot air) is required.

Figure 4C:
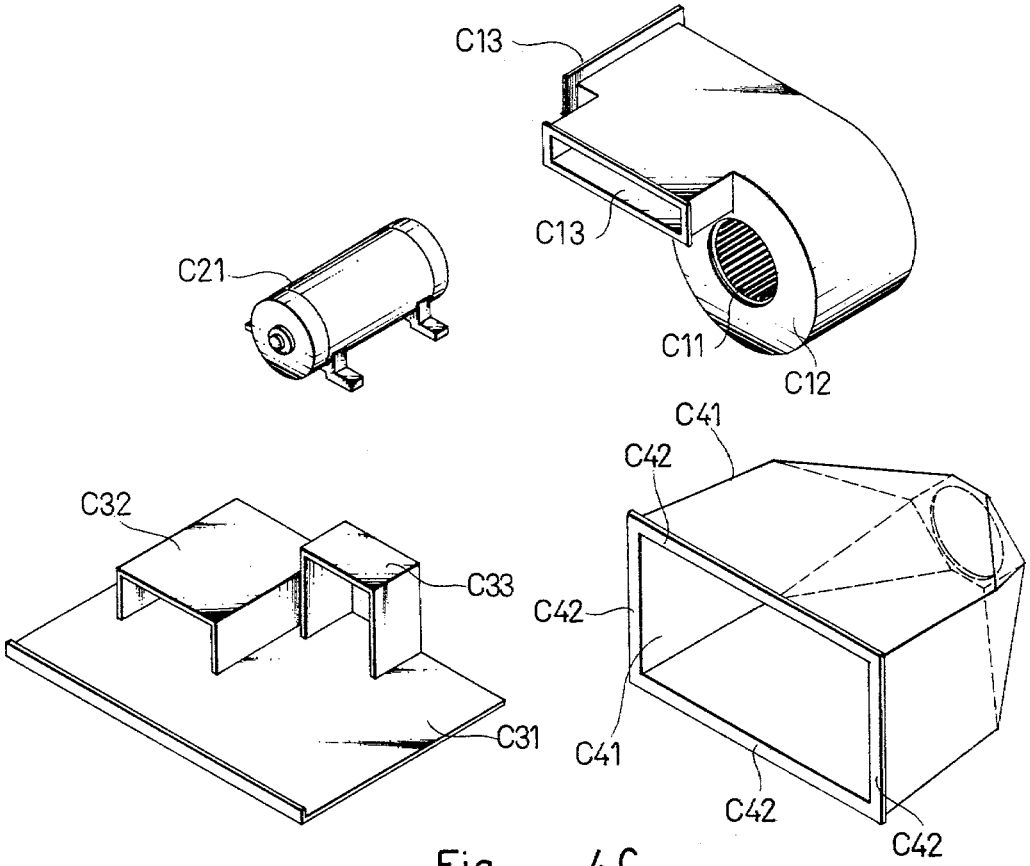

Those shown in FIG. 4C are the major components of the air extractor as illustrated in FIG. 4B.

Figure 5:
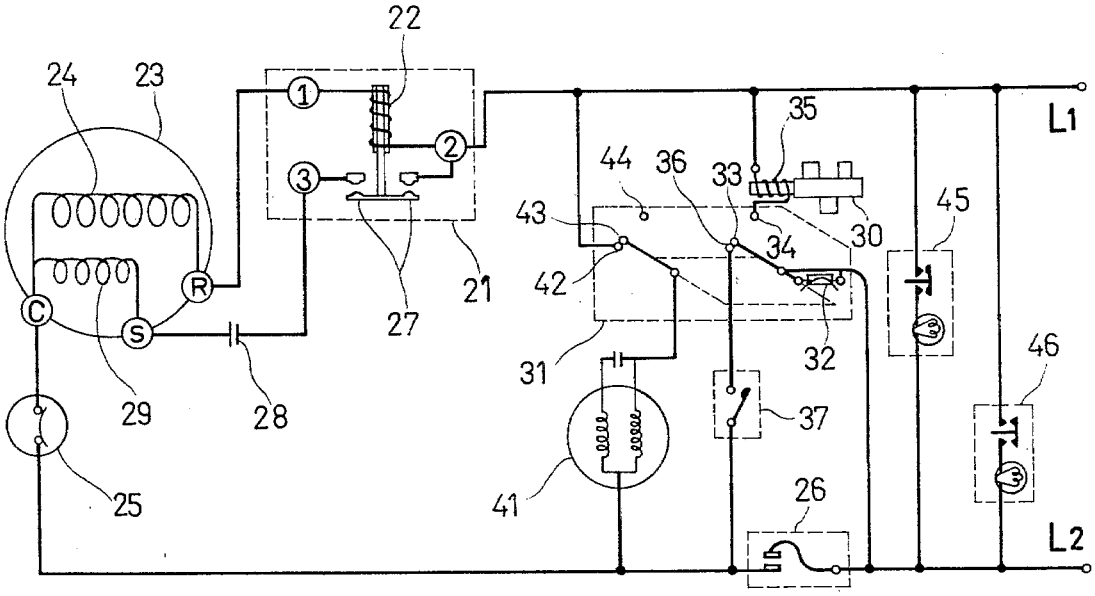

Shown in FIG. 5 are the operating conditions and operation schematic layout of the circuitry, under different temperature conditions, of the refrigerator-oven, namely, the present invention, in execution.

DETAILED DESCRIPTION

Known is that for the tubework, network of the conventional refrigerator or freezers, it is common practice to subject the low-pressured evaporating gas pass through the compressor, to scale up the pressure, thence fed out to the condenser, the condenser will manage to extract the heat of the high-temperatured gas, which will become liquid, most of the liquids, once stored in the liquid reservoir, will pass through the filtering net and flow back to the control valve, the control valve is meant to limit the quantity of the refrigerant to flow into the volatilator so as to best facilitate volatization. The refrigerant, once flown into the volatilator, will become volatilized into vapor or mist phase and absorb heat, that is, the potential heat that is generated when the liquid transforms into gas (vapor, steam), in the meantime so that the ambient temperature will decrease and feed out the high-temperatured evaporating vapor to the condenser via the compressor, they are further directed to the cool air in the surroundings through the surfaces of the pipe walls of the condensers, or else the potential heat as absorbed while the volatization is taking place in the volatilator may be removed by means of the cooling water circulating about outside the condenser. Such action, repeated over and over again may well achieve in the objective for which the refrigerator or freezer is intended to serve, however the fact that great quantity of the calorific power, that is, the heat energy, on the condenser are diffused into the atmosphere while no utilization whatever has been made of them is truly a gross waste that could have been turned into an asset, this has been a pity for a long time indeed.

In view of the wasteful imperfection as mentioned above, the inventors for this case have managed to afford some improvements so as to fully make use of the heat energy thus far diffused into the atmosphere and submitted the present invention for an evaluation. The refrigerator-oven as proposed herewith has an 'oven' specifically meant for temperature scale-up or temperature conservation, incorporated at a suitable location of the conventional refrigerator or freezer, wherefore the high-temperatured evaporation networks as the output of the compressor are directed to feed into the oven before the said networks are to be connected to the condenser, to undergo proper roving (the radiating tubeworks in the oven are to be hereafter referred to as radiating pipes, with types of horizontal alignment, vertical alignment and vortical model) so that the calorific power as contained in the tubeworks may be directed to the heat-conductor board, through the surface areas of the heat-conductor board the calorific power is distributed into the oven. There is still another method of radiation whereby the high-temperature evaporation pipes that are extended into the oven are connected to a fin-type radiator so that the heat energy may be transmitted to the surfaces of the fins, the said energy is further blown into the oven by means of the fan so as to achieve in convective recyclings, there is yet another method of application, suitable for the bulky refrigeration systems such as large refrigerator and freezers, since that its tonnage of refrigeration capacity is big, so the liquid refrigerant, will have to absorb great quantity of heat while undergoing the volatilization in the volatilator, and similarly, the compressor will also have to feed out evaporating vapor containing considerable contents of heat energy, so the faucet of the output evaporation tube should be coupled to the fin-type radiator, the fan is used to transmit the heat energy as contained in the fin-type radiator to the room requiring heating, in this way, the function of the warm-air conditioner is duly accomplished. The high temperature evaporation tube as the output from the compressor shall have to undergo various modes of radiation of heat and utilization before being coupled to the condenser, to remove the heat residual left over in the oven due to incomplete radiation of heat and become condensed as liquids, to be further connected to the liquid reservoir—and finally returning to the compressor.

In consideration of the differences in temperature as required by the objects as stored in the oven for heating or temperature conservation a 'thermosensor switch' is provided so as to alter the rated temperature of the oven, a certain part of the thermosensor switch will become dilated or contracted under certain different temperature conditions, so there is also provided a knob for the adjustment of dilating or contracting resilience with the provision of indication calibration for the rated temperature and the circuit joints that will change in distance apart with the occurence of dilation or contraction as well. Such a thermosensor switch, when duly matched in function with a 'trident valve', will be able to control the direction into which the evaporating vapor will flow via the heating pipe or the 'bridge pipe', thereby stabilizing the required rated temperature inside the oven and meeting the user's requirements. The said trident valve is a faucet joint that can change the flowing direction of the refrigerant that has three faucets with an electromagnetically controlled valve gate provided in the center. Wherein one input faucet is connected to the output pipe of the compressor (the bridge pipe is a pipework that is directly connected from one output of the trident valve to the condenser without passing through the interior of the oven), the two output faucets will not permit the evaporating vapor to flow out concurrently due to control by the trident valve, but will flow out via one output faucet or the other at one time.

When the temperature in the oven is below a certain prescribed value, the circuit joint in the thermosensor switch will switch off as a result of deformation due to contraction, and consequently the electromagnetic coil on the trident valve will not permit passage of current, so the valve gate of the trident valve, being controlled by the reduction spring, will close the faucet of the bridge pipe and drive the faucet of the heating pipe to open, so that the evaporating vapor as the output of the compressor would not get passed via the bridge pipe, but all flow through the heating pipe inside the oven and transmit all the calorific power stored in them to the heat-carrier board and all the heat energy will be distributed into the oven by way of the surface areas of the heat-carrier board, so as a result, the temperature inside the oven will continue to rise. The evaporating vapor, after going through the heat radiation action in the heating pipe, will continue to flow to the condenser, have all the residual heat leftover from the incomplete diffusion in the oven removed and become condensed in liquid state. And conversely, should the oven temperature becomes higher than a prescribed rated value, the circuit joint in the thermosensor switch, will become united as a result of deformation due to dilatation and effectuate passage of current through the electromagnetic coils on the trident valve to generate magnetic fluxes, as a result the valve gate at the center of the trident valve will slide about due to electromagnetically induced attractions and drive the faucet of the bridge pipe to open, in the meantime closing the faucet of the heating pipe, as a consequence the evaporating vapor as the output of the compressor will all flow through the bridge pipe to reach the condenser and refrain from passing through the heating pipe, therefore the oven temperature will decrease bit by bit. The evaporating vapor reaching the condenser via the bridge pipe will release heat with the aid of the condenser and become liquid.

The evaporating vapor, be it coming from the bridge pipe or from the heating pipe, once transformed into liquid at the condenser, will get stored in the liquid reservoir for some part, the remaining part will pass through the filtering net to the control valve, thence jetting out from the volatilator to accomplish the volatilization procedure, and after the liquid refrigerant has turned into steams, return to the compressor. From the above description it can be learned that when it is desired to adjust the rated temperature of the oven, it would only be necessary to adjust the knob on which calibration of the rated temperature is given, to achieve an alteration of the elastic force present in the thermosensor switch, deformed due to dilatation or contraction, so as to make an eventual determination of the sensitized temperature as induced by the strength of the elastic force of the deformation device. In such manner rated temperature of the oven can be changed accordingly. As for the rated temperatures of the 'exit gap' for the hot air to blow to the room and of the oven using a fin-type radiator, they are nevertheless maintained by the directions into which the evaporating vapor on the thermosensor switch and the trident valve control pipeworks are moving.

The refrigerator-oven, namely, the present invention, will not only assume the function due for ordinary refrigerator or freezer, but also under-take to provide the heating or temperature conservation operation for foods or compatible objects in the meantime without incurring extra consumption of electric power, it is truly a great convenience when considered for food preparation in cold weathers, for the late-comers for meals, for the warming up of the lunch-boxes, for those for whom it is customary to have some snacks or cookies between meals, for baby foods called for so frequently at morsel bits, and no less noteworthy, in applications in business domains, for the cafeteria, restaurants, snack bars and so forth. It is especially remarkably precious for the world today that is so badly in want of energy sources in that it can save the fuels that will be needed for warming up again the foods. For bulky refrigerator and freezers, however, because of a much too big tonnage of refrigeration capacity, the running time required becomes much longer and the mass quantity of heat energy as absorbed by the volatilator will have to be fed out, this means that the marvellous missions as mentioned before cannot be performed by them, but nonetheless it can serve to render the effects of indoor thermal inputs as ordinarily rendered by the warmth-conscious air conditioner, and serve in the saving of the cooling water as used by the water-cooling type of condensers, so in short, the desirability of the present invention, the refrigerator-oven and its range of application is far-reaching and beyond our efforts to enumerate all of them one by one.

The chief objective of the present invention is the provision of an evaporation pipeworks as the output of the compressor, its contents of heat energy are transmitted to the thermal board by way of the walls of the heating pipes of unlike types, such as horizontal alignment, vertical alignment and vortical mode, to be distributed into the oven through the surface area of the thermal board, or else to have the evaporation pipeworks coupled to a fin-type radiator so as to transmit all the heat contents to the surface of the fins, thenceforward blown into the oven with the aid of the centrifugal aspirator or propeller air-drafter, or blown into a room where hot air is required for useful application.

Still another major objective of the present invention is to provide for a temperature conservation pipe, a portion of pipework to be used from the output end of the compressor to the entry end of a trident valve, to be coated with heat-proof tubings or bundled with heat-resistant materials, meant to avoid premature cooling of the high temperature evaporating vapor that is pressed out of the compressor before flowing over to the oven.

Yet another major objective of the present invention is the provision of a thermosensor switch that will contract or dilate to deformation under different temperatures, together with a knob for the adjustment of resilient force of dilatation or contraction with proper indication of prescribed rated temperature calibrations, adjustment of said resilient force will alter the temperature of the engagement/disengagement of the circuit joint, the magnetic force as generated by the magnetic coil of the trident valve, to continue or to suspend, is to be controlled by the engagement/disengagement of the circuit joint so as to effectuate the movement of the valve gate of the trident valve.

Still another major objective of the present invention is to provide for a trident valve with three junction faucets, one of them is the input faucet, connected to the temperature conservancy tube, the others are two output faucets, respectively connected to the bridge tube and heating tube, because the two output faucets are controlled by the gate of the trident valve, the evaporating vapor will flow out via but one output end, or the other output end, so to say, the two output ends will not permit outflowing altogether at the same time, therefore the temperatures as the outlet of the warm air outlet or of the oven, will depend upon the individual outgoing directions of the evaporating vapor as the controlled output of the trident valve.

Still another major objective of the present invention is the provision of a certain bridge pipe, when the temperature at the outlet of the warm air outlet or of the oven exceeds a certain rated value, and that the evaporating vapor stops to pass through the heating tube or the fin-type radiator, the bridge tube shall constitute as the only by-pass through which the evaporating vapor destined to reach the condenser shall pass, the bridge pipe shall also take turns with the heating pipes in transporting the evaporating vapors so as to control the stability of the temperatures.

Still another major objective of the present invention is the provision of a filtering net, specifically it means a filtering net to be disposed in front of the fin-type radiator in the oven that can filter away all the dirty foreign materials as contained in the recycling hot airs in the oven. What is to be given below is an item by item description, in the company of attached drawings, of all the other objectives and characteristic features of the principles, efficacies of the present invention.

Figure 1:
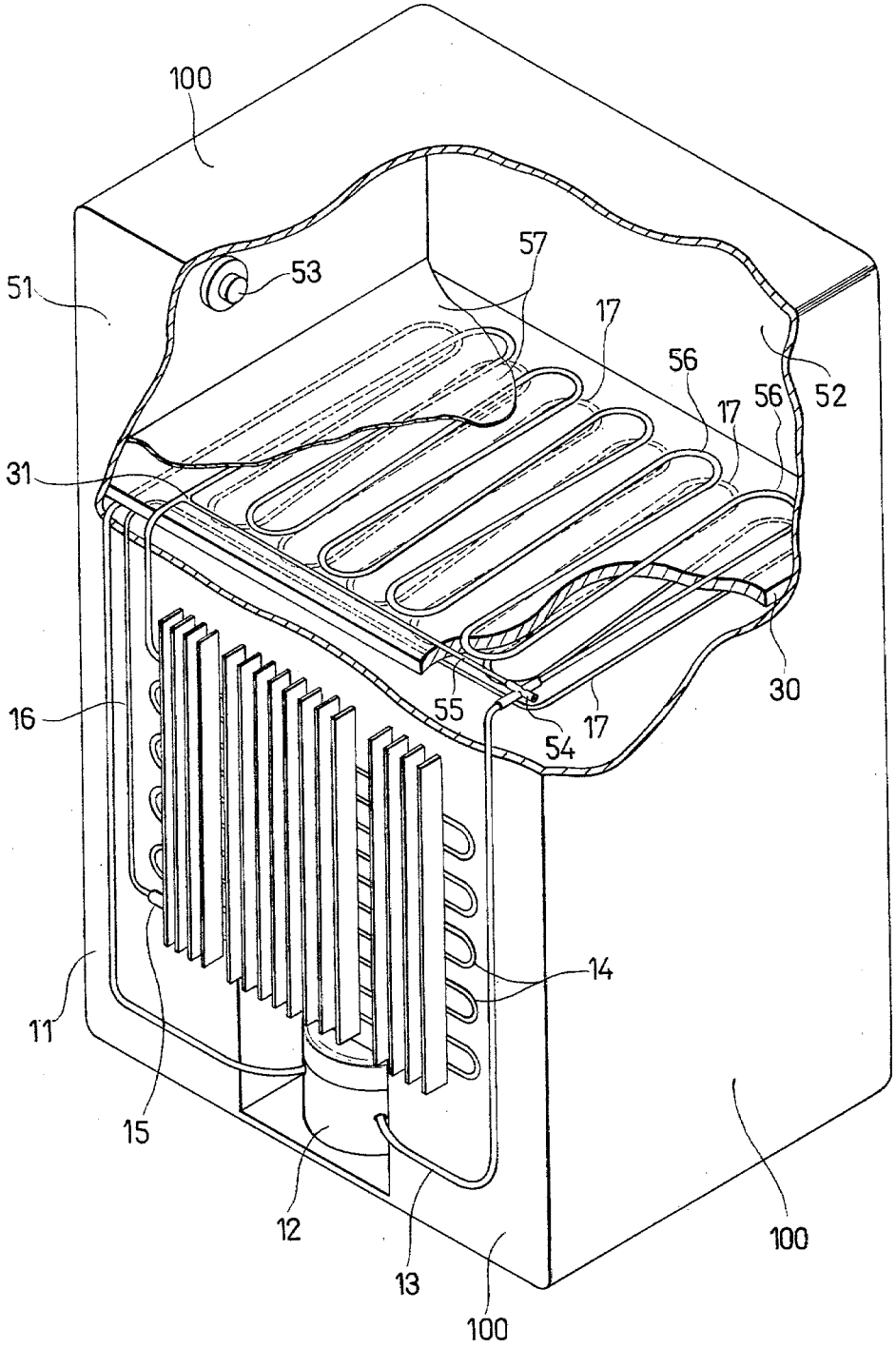

Shown in FIG. 1 is the three dimensional ideological graph of the refrigerator-oven complex, namely, the present invention, in execution, as viewed in part from the backside, wherein the temperature-tight frame (100) is composed of the lower section, namely, the refrigeration unit (11) and the upper section, namely, the oven body (51), the interspace is separated with a heat-insulation board (30) that is made of heat-proof materials so as to avoid interactions of the heating pipes (56) installed on the heat-insulation board (30) and the volatilator (17) installed in the lower portion from affecting each other due to difference in respective temperatures, the mechanism will function as follows, the low-pressured evaporating vapor, after being pressurized by the compressor (12) to reach a higher pressure, will feed out the temperature conservancy tube (13), sleeved in with adiabatic materials or bundled with adiabatic materials, to arrive at the trident valve (54).

When the oven (52) temperature falls below a certain rated value, the circuit joint in the thermosensor switch (53) will become deformed due to contraction and switch off, as a result the electromagnetic coil in the trident valve (54) will not permit passage of current, thereupon the gate of the trident valve (54), upon being pushed by the original spring piece, will shut out the pipeways of the bridge pipe (55), in the meantime drive the tubeways of the heating pipe (56) to open, so that the evaporating vapor that is fed out from the compressor (12) will not pass through the bridgepipe (55), but entirely flow through the horizontally aligned heating pipe (56) located in the oven, and carry all its heat contents to the thermal board (57), via the surface areas of the thermal board (57), the heat energy will be distributed into the oven (52) so that the temperature will continue to rise. The evaporating vapor that has undergone heat-radiation in the horizontal alignment type heating pipe (56) will flow by an intersection (31) to reach the condenser (14) in this condenser the calorific energy that has not completely radiated away while in the oven (52) will be removed and the said vapor will become eventually condensed in liquid.

And conversely, when the oven (52) temperature reaches a value that is higher than the rated value, the circuit joint in the thermosensor switch (53) will become deformed due to dilatation and get engaged, following this, the electromagnetic coil on the trident valve (54) will admit passage of current to generate magnetic fluxes, as a result the valve gate in the center of the trident valve (54) will slide due to attraction by the electromagnetic force and activate the opening of the pipeways of the bridgepipe (55), in the meantime shutting off the tubeways of the horizontally aligned heating pipes (56), as a consequence the evaporating vapor that is fed out from the compressor (12) will all flow by the bridgepipe (55), passing an intersection (31) to reach the condenser (14) and refrain from flowing through the horizontally aligned heating pipe (56), and therefore the oven (52) temperature will gradually decrease. The evaporating vapor arriving at the condenser (14) by way of the bridgepipe (55) will be deprived of heat with the aid of the condenser (14) and become liquid, the evaporating vapor, be it coming from the bridgepipe (55) or from the horizontally aligned heating pipe (56), once becomes liquid at the condenser (14), will become partially stored up in the liquid reservoir (15), the remaining part of the liquid after passing by the capillary control valve (16), will limit the influx of the refrigerant into the volatilator (17) by the very action of the capillary control valve (16), so as to best facilitate volatilization. The refrigerant flowing into the volatilator (17) will be volatilized to become vapor or mist, in the meantime absorbing heat (to absorb the potential heat resulting from the liquid's transformation into the vapor) and causing a lowering in the surrounding temperatures, this high temperature evaporating vapor is thence fed out from the temperature conservation pipe (13), i.e., the thermostat tube, by way of the compressor (12), such an operation, repeated over and over again, will attain the operational objectives demanded from the refrigeration system (11) and the oven proper (51), the entity of the refrigerator-oven complex, namely, the present invention.

Figure 2:
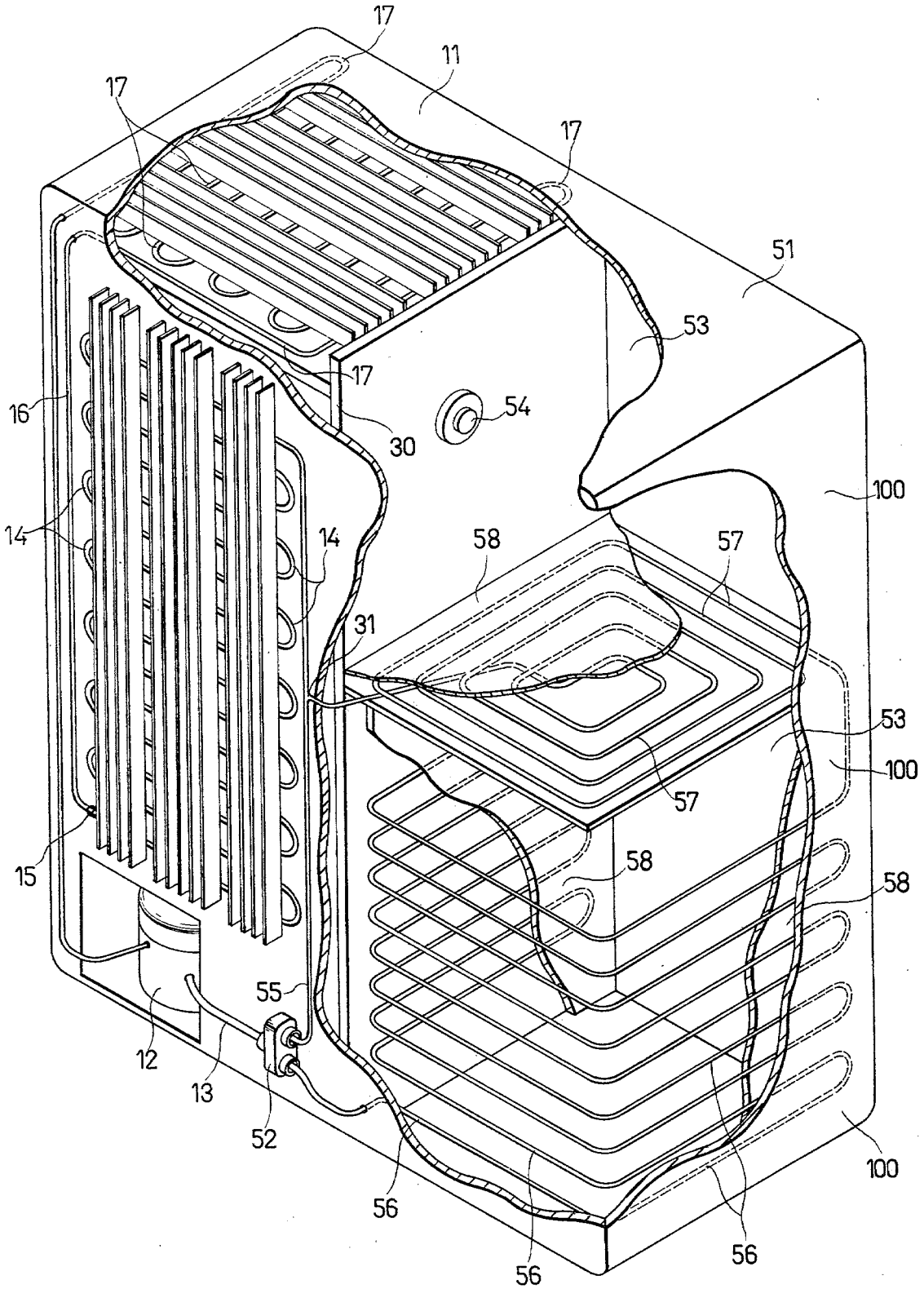

Shown in FIG. 2 is the three dimensional ideological graph of the refrigerator-oven complex, namely, the present invention, in execution, as viewed in part, from another angle. It is different from the graph shown in FIG. 1 in the location of the oven, layout of the oven proper and the manner of bending of the individual heating pipes inside the oven, whereas the operation principle of the circuitry is similar to those as covered in FIG. 1. In the present figure there is also present a temperature-tight frame case (100), composed of the refrigeration system on the leftside (11) and the oven proper (51) on the rightside, that portion in-between is separated with adiabatic board (30) so as to ensure the absolute independence of the different temperature in either side. The circuit network will function as follows, the low-temperature evaporating vapor is subjected to compression-treatment at the compressor (12) so as to increase in pressure, thence fed out from thermostat tube (13) to the trident valve (52), when the oven (53) temperature falls to a value that is lower than a prescribed rated value, the evaporating vapor that is fed out from the compressor (12), due to control as imposed from the thermosensor switch (54) and the trident valve (52), details of the control operation have been discussed earlier, will not be permitted to pass through the bridgepipe (55), but all flow through the vertically aligned heating pipe (56) and the vortical heating pipe (57), in the meantime transferring all its heat contents, by way of the pipewalls, to the thermal board (58), the heat contents are further distributed into the oven through the surface areas of the thermal board, so in the long run, there is induced an enhancement of temperature inside the oven (53), that will serve as the basis for the heating or warmth conservation of the foods stored in the oven; the evaporating vapor that has had heat-radiation treatment while in the vertically aligned and vortical heating pipes (56, 57), will pass by an intersection (31) and flow to the condenser (14), where it will get deprived of all the heat contents as leftovers during stay in the oven (53) and becomes liquid.

And conversely, when the oven (53) temperature is higher than a rated value, the evaporating vapor that is fed out from the compressor (12), due to control as imposed by the thermosensor switch (54) and the trident valve (52), their action of control has been discussed earlier, will all flow through a bridgepipe (55), passing an intersection (31) and reach the condenser (14) instead of flowing past the vertically aligned and vortical heating pipes (56, 57), it will result in the gradual dropping down of the temperature inside the oven (53). The evaporating vapor, when arriving at the condenser (14), will with the help of the condenser (14), get cleared of heat, and turn into liquid, the evaporating vapor, be it coming from the bridgepipe (55) or from the heating pipes (56, 57), once turned into liquid at the condenser (14), will flow past the liquid reservoir (15), passing the capillary control valve (16), arriving at the volatilator (17) to accomplish the volatilization process, thence volatilizing the liquid refrigerant into vapor or mist-form and return to the compressor (12), such operation is repeated all over again in cycles, to achieve at the performance efficiency for which the refrigerator-oven complex is intended to serve.

Shown in FIG. 3 is still another three dimensional ideological graph of the present invention, in execution, as viewed from the backside. The present graph is primarily different from the two previous graphs in the type of the heating pipe and its manner of heat-radiation, but all the three executions are practically the same in circuit principles and performances. A temperature-tight frame case (100) is divided into an oven proper (51) in the left part and a refrigeration system (11) on the right part, an adiabatic board (30) is inserted inbetween so as to provide absolute independent temperature contexture for both parts. The circuit operates as follows, the low pressure evaporating vapor passing past the compressor (12) to get increased in pressure, thence feeding out the thermostat tube (13) to arrive at the trident valve (52), when the oven (53) temperature falls below a rated value, due to control by the thermosensor switch (54) and by the trident valve (52) (principle of control duly described in paragraph for FIG. 1), the evaporating vapor will not flow to the bridge pipe (55), but all flow past the fin-type heat radiator (56), and transmit, by way of the pipewalls, all its heat contents to the surface of the fins, when the motor (57) drives the fan for rotation, it will draw the air from the upper portion of the oven (53), the heat as contained on the surface of the fins will be transported by the interspace between the isolating board (59) and the adiabatic board (30) (as indicated by the arrow 62), by way of the filtering net (60) into the oven (53). Since the hot air is lighter, it will drift upwardly, passing the grid rack (61) to reach the top of the oven, there to be attracted down by the fan to blow the heat contents on the surface of the fins into the oven (53), such a procedure is recycled over and over again, resulting in a cycling of hot air following the direction as indicated by the arrow in the oven (53), the consequence is that the stored food objects, at any corner whatever in the oven, can benefit from the warmth afforded by the hot air flow, further to that, any dirty foreign materials, if existed, in the recycling hot air in the oven (53), will all get entirely filtered off at the filtering net (60) so as to provide a high standard of cleanliness for the foods stored in the oven. The evaporating vapor, after radiation treatment in the fin-type radiator (56), will flow past the intersection (31) to the condenser (14), where the heat contents leftover from the stay in the fin-type radiator (56) will be cooled off again to turn into liquid.

When it occurs that the oven (53) temperature is higher than a certain rated value, due to the control effected by the thermosensor switch (54) and the trident valve (52), (principles of the controlling action already given in the paragraph for FIG. 1 earlier), the evaporating vapor will not flow to the fin-type heat radiator (56), but all flow past a bridgepipe (55), passing an intersection point (31) to the condenser (14) instead, the condenser (14) will function to remove all the potential heat that is absorbed by the refrigerant liquid while being volatilized in the volatilator, to the effect that the evaporating vapor will finally become substantiated as liquids. Most liquids, after being stored in the liquid reservoir (15) will pass past the filtering net (15) (the liquid reservoir and the filtering net are both in one assemblage) to arrive at the capillary control valve (16), whereby the volume of the refrigerant flowing into the volatilator (17) is limited so as to best facilitate volatilization. The refrigerant flown into the volatilator (17) will get volatilized as vapor or into mist-form, in the meantime absorbing heat, the evaporating vapor is further subjected to flow into the compressor (12). Such operation recycled all over again will attain the refrigeration and the temperature conservation efficiency for the refrigerator-oven complex.

Shown in FIG. 4A is yet another three dimensional ideological graph of the present invention, in execution, in partial layout, as viewed from the frontage. The present graph is different from the previous ones in the expanded volume of the whole entity, the unique feature of the cooling fan, and the radiated heat to accommodate different applications. Whereas its circuitry principles and performances are, on the whole, identical to those as covered by the previous graphs, it is in essence a grand-scale cooling mechanism for conventional refrigeration purpose. Because of its heavy refrigeration tonnage, it will have to absorb great quantity of heat from the volitilator (to absorb the potential heat as derived from the liquid refrigerant into the vapor state by means of volitilization), in the meantime transferring masses of heat from the condenser into the atmosphere, so as to condense the evaporating vapor into liquids, the present execution is meant to give warmth to the stored foods, objects, and to have the hot air blown to the rooms requiring it, so as to achieve in the adjustment of room temperature by means of the masses of heat energy that are fed out into the atmosphere. For which there is also provided a temperature-tight frame case (A100), composed of the oven proper on the upper side (A51) and the refrigeration mechanism (A11) underneath, an adiabatic board (A30) is provided in-between for separation for both, it can serve to avoid the interactions of different temperatures on either side. The pipework circuitry will operate as follows, the low temperature evaporating vapor, after having been subjected to pressure-enhancement treatment in the compressor, is fed out from the thermostat pipe (A13) to get to the trident valve (A52), when the oven (A53) temperature or the temperature at the outblowing aperture (A54) is lower than a certain rated value, due to control action by the thermosensor switch (A55, A56) installed within the oven (A53) or the outblowing aperture (A54) (the description of the controlling action already given earlier), the evaporating vapor, while reaching the trident valve (A52), would not flow to the bridgepipe (A57), but all flow past the heating pipe (A58) located within the oven, thenceforward flow to the fin-type heat radiator (A59) instead. The heat as contained in the evaporating vapor, is partially transmitted to the thermal board (A60) by way of the pipewall of the heating pipe (A58), thence distributed to the interior of the oven (A53) through the surfaces of the thermal board, and partially transmitted to the surface of the fins via the fin-type radiator (A59). Thence fed on to the centrifugal draft mechanism as illustrated in FIGS. 4B and 4C, composed of blind fan (C11), crank case (C12) with outlet (C13) for coupling effects, motor (C21), chasis (C31) with motor seat (C32) and crank case frame (C33), draft funnel (C41), this draft mechanism is installed in the space as indicated by the arrow (A61) in FIG. 4A, so to speak, installed at the back of the fin-type radiator (A59), the front edge (B11) of the draft funnel of the draft mechanism (FIG. 4B) lies adjacent to the rear edge of the fin-type radiator (A59), since that the power source of the motor of the centrifugal draft mechanism is also under the control of the thermosensor switch (A55, A56), as long as there is evaporating vapor passing past the heating pipe (A58) or the fin-type radiator (A59), the said motor will be activated by the power source and start rotation, with the transmission of the belt, drive the blind fan (B12) of the centrifugal draft mechanism to rotation, and absorb the air in front of the fin (A59) via all the fine gaps between the fins, in the meantime carries away the heat existing on the surfaces of the fins, to be blown via the draft funnel (B13), thence thrown out of the crank case (B14) with the action of the centrifugal force, thence blown to the room requiring the hot air by way of the outlet (outblowing aperture) (B15), in such a manner the function of a warmth-conscious air-conditioner is achieved. The evaporating vapor, having undergone the radiation-treatment during its stay in the heating pipe (A58) and in the fin-type radiator (A59), will flow past an intersection point to arrive at the condenser, whereby the heat content as leftover from precedent heat-treatment procedures will be cooled off once again and eventually turned into liquid.

When the oven (A53) temperature or the temperature at the outlet (A54) is at a value that is higher than a certain rated value, the control of the thermosensor switch will take action (A55, A56) resulting in the impossibility of the evaporating vapor to pass to the heating pipe (A58) and the fin-type radiator, but all flow through the bridgepipe (A57) to arrive at the condenser, where the potential heat as absorbed by the liquid refrigerant while being volatilized in the volatilator will be removed, to the effect that the vaporating vapor will turn into liquid. Most liquid after being stored in the liquid reservoir, will pass past the filtering net, then the control valve, where the refrigerant's inflow into the volitilator will be limited so as to facilitate the volitilization process, the refrigerant, once flown into the volitilator, will become volitilized into vapor or mist-form, in the meantime absorb the heat from the surroundings, thence having the evaporating vapor flow into the compressor, such operation repeated all over again will enable the refrigerator-oven complex to exhibit its efficiency in the dual respects of refrigeration and warmth provision.

Shown in FIG. 5 is the ideological scheme of the circuit operation of the present invention, in execution, under different temperature conditions, these conditions may be defined as follows:

1. The operation condition wherein the refrigerator-oven complex is just switched on power to start up working, that is to say, when the temperature of the refrigerator is higher than a certain rated value, and the temperature of the oven is below a certain rated value.

When L1 and L2 are turned on, the current will go from L1, through the electromagnetic coil (22) of the three-point activation relay (21) to the main coil (24) of the motor (23), serving to activate the compressor, thence move to the overload-protection relay (25), and return to the power source L2 by way of the thermostat (26), since the electromagnetic coil (22) of the three-point activation relay (21) is connected in series with the main coil (24) of the motor (23) serving to activate the compressor, so the motor (23) will not run on the account that the activating coil (29) is not switched onto the power source, as a result the current in the electromagnetic coil (22) will increase incessantly, by and by the two circuit joints (27) of the activation relay (21) will be drawn up causing the current to travel through the driving capacitor (28) unto the activating coil (29) of the motor (23), to the effect that when the motor (23) has attained a suitable rated speed, the electromagnetic coil (22), due to decreasing in current, will drop down the two circuit joints so far drawn up to contact (27) and off the supply current for the activating coil (29), by then the motor (23) will drive the compressor to a normal running, in the meantime the functions in the oven and in the refrigerator will be in progression, and as a consequence, the temperature in the oven will continue to rise, and the temperature of the refrigerator will drop down in counterpart.

2. The condition wherein both temperatures of the refrigerator and the oven are higher than a certain rated value. Under such conditions due to provision of the thermosensitizing deformation device as installed in the thermosensor switch (31) inside the oven, it will push the switch contact (33) to come into in contact with the joint point (34) of the electromagnetic coil in the trident valve (30), so that the current will travel through the electromagnetic coil (35) to generate electromagnetic force and draw in the valve gate in the trident valve (30), shut off the faucet of the heating pipe and also open the faucet of the bridgepipe, so that all the evaporating vapor will pass through the bridgepipe to arrive at the condenser and refrain from passing the heating pipe, all this will result in the gradual lowering down of the temperature inside the oven and the temperature of the refrigerator, to the rated value on either part.

3. Conditions wherein the temperature of the refrigerator is higher than a certain rated value, while the oven temperature falls below a certain rated value. Under such conditions because the thermosensitizing deformation device (32) will push back the joint contact (33) of the thermosensor switch, so it would leave the electromagnetic coil joint point (34) and unite with another circuit terminal (36), so that the current will fail to pass through the electromagnetic coil, what's more, the valve gate of the trident valve will be pushed to its original position by the reduction spring, that means, the faucet of the bridgepipe is closed, but the faucet of the heating pipe will be made to open, the consequence is that the evaporating vapor will fail to pass by way of the bridgepipe, but all flow through the heating pipe, all these will substantiate in the continuing increase of the temperature within the oven and the continuing decrease of temperature within the refrigerator.

4. Conditions wherein temperatures within both the refrigerator and the oven are lower than a rated value. Under such conditions because the circuit joint of the thermostat (26) in the refrigerator will jump off, so the motor (23) will stop running, as a result the compressor will feed out nothing, at this juncture it is practicable to connect the circuit joints of the option switch (37), so as to make all the current failing to pass through the thermostat (26) reroute via the option switch (37), thence the circuit joints (36, 33) to return to the source L2. So that a parallel circuitry is provided for the thermostat (26) forbidding the passage of currents, so that the motor (23) will drive the compressor to action again and bringing about the gaining of temperature within the oven.

Acquaintance of the operation principles of the thermosensor switch and the trident valve can be obtained when the various temperature conditions as described above are understood, it is also learned therefrom that when connection of circuit joints is made on the option switch (37), although the temperature of the refrigerator is lower than a rated value, and that the circuit joint of the thermostat (26) will jump off, the motor (23) will nevertheless remain unaffected and drive the compressor to rotation, and it will not stop until the temperature within the oven reaches a certain rated value, this could be viewed as though the oven is the leader whereas the refrigerator is the follower, that is to say, the refrigerator will act in such a manner as to best meet the operative status quo of the oven. On the contrary, when the open-circuit status is selected on the option switch (37) to function, granted that the oven temperature is higher than the rated value, the motor (23), however, will act notwithstanding to drive the compressor to rotation till the temperature of the refrigerator reaches a certain rated value and that the thermostat jumps off, so it could also be viewed as if the refrigerator is the leader, whereas the oven is the follower, that is to say, the oven will act in such a manner as to best comply with the operative status quo of the refrigerator, from these explanations, it becomes clear that it will only be necessary to make a selective tapping on the option switch (37) to realize in rendering an active or passive function for either part, the refrigerator or the oven.

The fan motor for blowing off the heat as contained in the fin-type radiator has its current flown in from the power source L1, to travel through the circuit joints (42, 43) of the thermosensor switch (31) to reach the fan motor (41), thence flow back to source L2, wherein the space between the two switching rotors (43) and (33) within the thermosensor switch (31) is connected with the insulating substance, and also responds to the thermosensitizing deformation device (32) by jumping in like directions. When the oven temperature falls below a certain rated value and that the rotor joint (33) of the switch within the thermosensor switch (31) contacts with the circuit joint (36), another rotor joint of the switch (43) will also get in contact with the circuit joint (42), moreover, when the oven temperature is higher than a certain rated value and that the rotor joint (33) in its thermosensor switch (31) leaves the circuit joint (36) and contacts with the joint (34) forthwith, the other rotor joint (43) will also leave the circuit joint (42) and forthwith contacts with the circuit joint (44), in this manner the fan motor (41) will rotate along with the passage of the evaporating vapor in the course of the fin-type radiator, and also stop running as the evaporating vapor passes through the bridgepipe. Should something other than the fin-type radiator is used in the oven to blow off heat, then the fan motor (41) and the networks of the circiut joints (42), (43), (44) in the thermosensor switch can be omitted, (the joint (44) is meant to avoid undue swinging of the rotor (43), it has nothing to do with any circuit whatever), as for the indoor lamp and the door key (45), (46), they are meant to increase illumination effects for the refrigerator and the oven, when the case door is being opened, the door key will automatically effectuate the switching onto the power source, whereupon the current will pass through the indoor lamp to enlighten it in order that illumination may be provided within the case compound, and conversely, when the door is closed, the door key will automatically shut off the power source for the indoor lamp. All the instances of executions so far discussed serve but as the better formations of the present invention for practical exploitation, but they will by no means limit the range of application exclusively appropriate for the present invention pending for a patent permit, all requests that may fall into the categorical pertinence as covered by the claims based on the present invention are within the coverage of protection submitted for approval for the said invention.

To summarize all the foregoing descriptions, suffice it to say that the refrigerator-oven complex, namely the present invention, is the additional incorporation of a temperature-tight, empty encasement (oven), with doors provided, at a suitable location around the conventional refrigerator or freezer, whereby the heat contents as contained in the condenser (heating pipes), are distributed into the empty encasement (oven) by means of different methods of heat radiation, so as to provide warmth or temperature conservation for the foods and objects stored therein, or else the evaporation pipes as the output of grand-scale bulky refrigeration facility that contains masses of heat energy, are connected to a fin-type radiator, so that the calorific power as transferred thereto is drawn, by means of the fans, to the room wherein hot air is called for, so as to provide for the adjustment of room temperatures, there are also provided a thermosensor switch and a trident valve for the control of the radiated heat so as to attain at the prescribed rated temperature as required. Under the condition that no affects are incurred to the refrigeration function and that no additional electric power is required, it may achieve in the saving of the fuels needed for the warmth provided for the foods and objects and the full utilization of the heat energy as residual leftovers scattering in the atmosphere and mass reductions in the casual waste of calorific powers, in view of all these statements, the present invention, namely, the refrigerator-oven, is truly an ideal and practical innovation.

I claim:

1. A refrigerator-oven complex comprising a refrigerator space and an oven space thermally insulated from one another, and a refrigerating-heating system for cooling said refrigerator space and for heating said oven space, said system containing a refrigerant and comprising a cooling coil in said refrigerator space, a heating coil in said oven space, a motor-driven compressor for compressing refrigerant vapor received from said cooling coil, a condensor for compressed refrigerant vapor, a trident valve having an inlet connected with the output of said compressor, one outlet connected with an inlet of said heating coil and another outlet connected by a bridge pipe to an inlet of said condenser, an outlet of said heating coil being connected with an inlet of said condenser, refrigerant storage means having an inlet connected with an outlet of said condenser and an outlet connected through a controllable capillary valve with said cooling coil whereby said cooling coil with said capillary valve comprises a volitilator, means for sensing the temperature in said oven space, and means responsive to said sensing means for controlling said trident valve to direct hot compressed refrigerant vapor from said compressor through said heating coil to said condenser when the temperature in said oven space is below a predetermined value and to direct said hot refrigerant vapor through said bridge pipe to said condenser when the temperature in said oven space is above a predetermined value.

2. A refrigerator-oven complex according to claim 1, in which said heating coil is connected through said trident valve to said condenser by pipes which are thermally insulated to provide heat conservation.

3. A refrigerator-oven complex according to claim 1, further comprising fan means for blowing air past said heating coils to heat a selected space.

4. A refrigerator-oven complex according to claim 3, comprising fins on said heating coil, said fan means blowing air between said fins.

5. A refrigerator-oven complex according to claim 1, comprising means for setting a desired temperature of said oven space.

6. A refrigerator-oven complex according to claim 1, in which said heating coil is mounted on a metal thermal board which transmits heat from the heating coil to the space to be heated.

7. A refrigerator-oven complex according to claim 1, in which said heating coil comprises a fin-type radiator, and in which a motor-driven fan blows air through said fin-type radiator into said oven space.

8. A refrigerator-oven complex according to claim 7, in which said oven space is bounded by spaced walls forming between them a passage leading from the top of said oven space to said fin-type radiator whereby air is drawn down by said fan through said passage to said fin-type radiator and recirculated back to said oven space.

9. A refrigerator-oven complex according to claim 8, comprising means for filtering the recirculated air.

10. A refrigerator-oven complex according to claim 1, comprising control means responsive to the temperature in said refrigerator space and in said oven space to operate said compressor when the temperature in the refrigerator space is above a predetermined value and the temperature in the oven space is below a predetermined value.

* * * * *